US007325989B2

(12) United States Patent
Itoh

(10) Patent No.: US 7,325,989 B2
(45) Date of Patent: Feb. 5, 2008

(54) PAPER SUPPLY APPARATUS AND IMAGE FORMATION DEVICE

(75) Inventor: Keiji Itoh, Saitama (JP)

(73) Assignee: Fuji Xerox Co., Ltd., Tokyo (JP)

( * ) Notice: Subject to any disclaimer, the term of this patent is extended or adjusted under 35 U.S.C. 154(b) by 0 days.

(21) Appl. No.: 11/258,056

(22) Filed: Oct. 26, 2005

(65) Prior Publication Data

US 2007/0003353 A1 Jan. 4, 2007

(30) Foreign Application Priority Data

Jul. 1, 2005 (JP) ..... 2005-193940

(51) Int. Cl.
*B41J 15/02* (2006.01)
*B41J 15/04* (2006.01)

(52) U.S. Cl. ..... 400/613; 400/611

(58) Field of Classification Search ..... 400/613, 400/609, 611

See application file for complete search history.

(56) References Cited

U.S. PATENT DOCUMENTS 4,968,882 A * 11/1990 Tzeng et al. ..... 250/231.14
5,172,148 A * 12/1992 Ezawa ..... 396/406
5,178,378 A * 1/1993 Nakajima ..... 271/116
5,444,525 A * 8/1995 Takahashi et al. ..... 399/76
5,598,201 A * 1/1997 Stodder et al. ..... 347/104
5,622,440 A * 4/1997 Yamamoto et al. ..... 400/234
5,678,815 A * 10/1997 Sheng ..... 271/10.13
5,751,303 A * 5/1998 Erickson et al. ..... 347/16
5,873,441 A * 2/1999 Tsujishita ..... 192/46
6,095,040 A * 8/2000 Ashikagaya et al. ..... 101/120
6,457,885 B1 * 10/2002 Yamamoto et al. ..... 400/207
6,827,421 B2 * 12/2004 Nunokawa et al. ..... 347/19

FOREIGN PATENT DOCUMENTS

JP 5-338335 A 12/1993

* cited by examiner

*Primary Examiner*—Daniel J. Colilla
*Assistant Examiner*—Matthew Marini
(74) *Attorney, Agent, or Firm*—Sughrue Mion Pllc.

(57) ABSTRACT

A paper supply apparatus provided with a support component, a slit plate and a rotation force transmission component. The support component freely rotatably supports a winding core around which roll paper is wound. The slit plate rotates integrally or interlockingly with the support component, and causes pulses to be generated at a sensor. The rotation force transmission component transmits a rotation force of the support component to the slit plate. At the rotation force transmission component, predetermined free play in a direction of rotation of the slit plate is provided.

14 Claims, 10 Drawing Sheets

RELATED ART

PAPER SUPPLY APPARATUS AND IMAGE FORMATION DEVICE

CROSS-REFERENCE TO RELATED APPLICATION

This application claims priority under 35 USC 119 from Japanese Patent Application No. 2005-193940, the disclosure of which is incorporated by reference herein.

BACKGROUND OF THE INVENTION

1. Field of the Invention

The present invention relates to a paper supply apparatus which feeds roll paper wound around a winding core, and an image formation device which is equipped with this paper supply apparatus, and more particularly relates to a paper supply apparatus and image formation device provided with a sensor for detecting when there is no more roll paper.

2. Description of the Related Art

Apparatuses which are mounted at image formation devices, such as copiers, facsimile machines, printers and the like, and which supply recording paper wound in the form of a roll (hereinafter referred to as roll paper) are well known. At a roll paper paper supply apparatus, accurate detection of a paper end when there is no more roll paper and detection of the paper end without any influence from the type of the paper are difficult, and paper supply apparatuses with various detection methods have been proposed heretofore.

For example, a paper supply apparatus has been proposed in which an outer peripheral surface of a winding core around which roll paper is wound is colored black, a light-emitting member irradiates light toward the roll paper that has been installed in the paper supply apparatus, and a reflection-type sensor which measures an amount of light reflected from the roll paper is provided. A paper end is detected in accordance with a difference between an amount of light reflected when there is roll paper and an amount of light reflected from the outer peripheral face of the winding core when there is no more roll paper.

However, with the method described above, it is necessary that winding cores be colored black. Moreover, even given the same black color, errors may occur in paper end detection because of some winding cores featuring glossiness and others not, and there are many limitations on materials and fabrication methods of the winding cores. Furthermore, there is also a problem in that errors may occur in paper end detection in cases in which the paper has high transparency.

For another method, for example, a detection apparatus 200 of Japanese Patent Application Laid-Open (JP-A) No. 05-338335, as shown in FIG. 10, has been proposed. At this detection apparatus 200, a slit plate 204 is attached to a roll paper fixing shaft 202, which rotates in accordance with an operation of drawing of roll paper P (paper supply and conveyance). A photosensor 206 is provided, which detects slits 204A formed in the slit plate 204. Hence, the slits 204A of the slit plate 204 which rotates in accordance with conveyance of the roll paper P are detected by the photosensor 206, and a remaining amount of roll paper is detected on the basis of a period of signals that the photosensor 206 outputs. Further, for this method, it has been written that the fact that there is no more roll paper can be detected by the slit plate 204 consequently not rotating any more and the above-mentioned signals not being generated.

Thus, when the detection apparatus 200 as described in JP-A No. 05-338335 is employed, it is possible to detect changes in an outer diameter of the roll paper P, and it is possible to detect that there is no more roll paper P from the fact that the roll paper fixing shaft 202 is not rotating any more.

However, with ordinary roll papers, a trailing end portion is often fixed to the winding core. In such a case, when there is no more roll paper, it is not possible to draw out the roll paper further. Therefore, the roll paper slips at a conveyance roller section. At this time, if the slit plate 204 is fixed to the roll paper fixing shaft 202, as in the method described in JP-A No. 05-338335, the slit plate 204 does not rotate, but small agitations thereof occur repeatedly. As a result, it is mistakenly detected that pulses corresponding to rotation of the roll paper are being generated. In consequence, a failure in which the detection of there being no more roll paper is greatly delayed occurs and, depending on circumstances, a failure in which a paper jam is mistakenly detected occurs.

To avoid erroneous detection of small oscillations, a method in which a spacing of the slits of the slit plate is widened has been considered. However, in such a case, a problem of it not being possible to precisely detect a remaining amount of the roll paper would occur.

SUMMARY OF THE INVENTION

The present invention has been devised in view of the above circumstances and provides a paper supply apparatus and an image formation device.

A first aspect of the present invention is a paper supply apparatus including: a support component, which rotatably retains a winding core round which roll paper is wound; a slit plate, which rotates integrally or interlockingly with the support component for causing pulses to be generated at a sensor; and a rotation force transmission component, which transmits a rotary force of the support component to the slit plate, wherein predetermined play in a direction of rotation of the slit plate is provided at the rotation force transmission component.

A second aspect of the present invention is an image formation device which is equipped with the paper supply apparatus of the first aspect, and which conveys the roll paper, which is fed from the paper supply apparatus, to an image formation section and forms an image on the roll paper.

BRIEF DESCRIPTION OF THE DRAWINGS

Embodiments of the invention will be described in detail with reference to the following figures, wherein.

DETAILED DESCRIPTION OF THE INVENTION

Below, preferred embodiments of the present invention will be described in accordance with the drawings.

Figure 1:
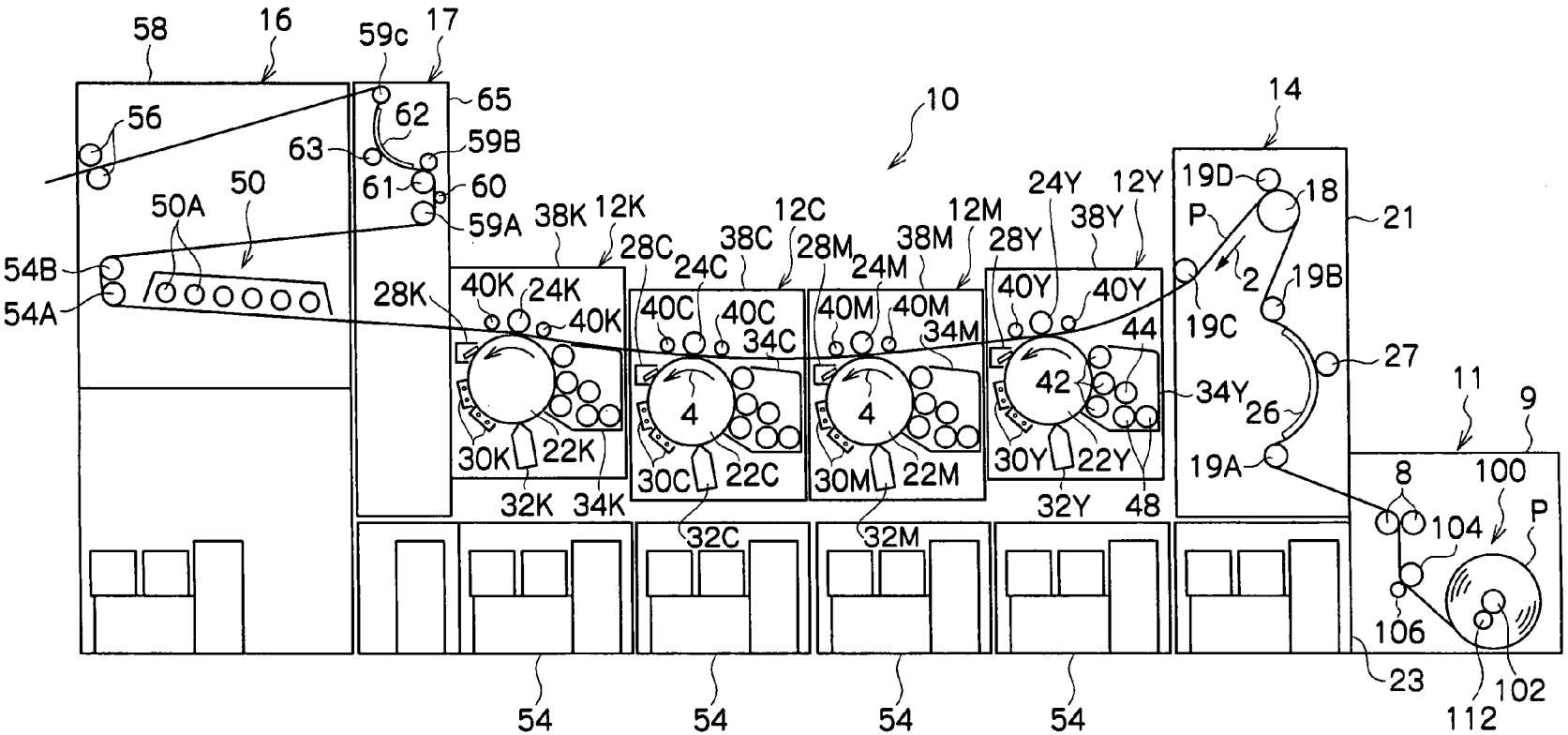
FIG. 1 is a schematic structural diagram showing a printer which is provided with a paper supply apparatus relating to a first embodiment of the present invention.

As shown in FIG. 1, a color laser printer 10 (hereafter referred to as "printer") is equipped with a paper supply section 11, which feeds roll paper P which has been wound into the form of a roll. A paper supply apparatus 100 relating to a first embodiment of the present invention is provided at this paper supply section 11.

At the paper supply apparatus 100, the roll paper P, which has been wound onto a winding core 103 (see FIG. 2) is supported in a state in which a roll paper shaft 102 passes therethrough, and is set at a predetermined paper supply position in the paper supply section 11. The paper supply apparatus 100 is also provided with a paper feed roller 104, which feeds out the roll paper P, and a pickup roller 106, which causes the roll paper P to abut against the paper feed roller 104. Structure of this paper supply apparatus 100 will be described later.

At the paper supply section 11, a pair of conveyance rollers 8 are disposed at a downstream side of the paper feed roller 104, for conveying the roll paper P that is being fed out. The roll paper shaft 102, the paper feed roller 104, the pickup roller 106 and the conveyance rollers 8 are supported at a paper supply section frame 9, directly or via support members.

Further, in the printer 10, printing sections 12Y, 12M, 12C and 12K (below referred to as printing sections 12Y-K) are arranged in this order from a conveyance direction upstream side. The printing sections 12Y-K sequentially transfer and superimpose respective toner images of the colors yellow (Y), magenta (M), cyan (C) and black (K) onto the roll paper P. At a conveyance direction upstream side of these printing sections 12Y-K, a paper conveyance section 14 is provided. The paper conveyance section 14 conveys the roll paper P to the printing sections 12Y-K, as shown by arrow 2. At a conveyance direction downstream side of the printing sections 12Y-K, a fixing section 16 and a paper ejection section 17 are provided. The fixing section 16 fixes the unfixed toner images which have been transferred by the printing sections 12Y-K to the roll paper P. The paper ejection section 17 ejects the roll paper P that has passed through the fixing section 16.

Herein, where it is necessary to distinguish between Y, M, C and K, descriptions will be given with one of Y, M, C and K appended to reference numerals. Where it is not necessary to distinguish between Y, M, C and K, these letters will be omitted.

The paper conveyance section 14 is provided with a main driving roller 18, around which the roll paper P is wound. The main driving roller 18 is driven by a paper conveyance motor, which is a stepper motor. A control section, which administers overall control of the printer 10, controls feed amounts of the roll paper P by numbers of pulses of this paper conveyance motor.

At a conveyance direction upstream side of the main driving roller 18 of the paper conveyance section 14, idling rollers 19A and 19B, around which the roll paper P is wound, are provided. At the conveyance direction downstream side of the main driving roller 18, an idling roller 19C, around which the roll paper P is wound, is provided. Furthermore, an idling roller 19D presses against the main driving roller 18. The idling roller 19D and main driving roller 18 nip and convey the roll paper P.

A conveyance guide 26 and an aligning roller 27 are disposed between the idling roller 19A and the idling roller 19B. A 'U'-like curved surface and a side guide are formed at the conveyance guide 26. The roll paper P is wound around the curved surface. The side guide guides one end portion of a width direction (i.e., a direction intersecting the conveyance direction) of the roll paper P.

The aligning roller 27 is a roller with a width which is significantly narrower than the idling rollers 19A, 19B, 19C and 19D, and with a rotation axis which intersects the conveyance direction of the roll paper P at an angle. Thus, the aligning roller 27 abuts against the width direction one end portion of the roll paper P and causes the roll paper P to move toward one end side in the width direction. As a result, the width direction one end portion of the roll paper P meets with a guide rib of the conveyance guide 26, and skewing of the roll paper P is corrected.

Here, the main driving roller 18, the idling rollers 19A, 19B, 19C and 19D, the paper conveyance motor, the conveyance guide 26 and the aligning roller 27 are supported at a paper conveyance frame 21, directly or via support members. Further, the paper conveyance frame 21 is supported at a base 23.

The printing sections 12Y-K are provided with photosensitive bodies 22. Around each of these photosensitive bodies 22, a transfer roller 24 of the present invention, a cleaning apparatus 28, an electrostatic charger 30, an LED head 32 and a developing apparatus 34 are arranged in this order in a direction of rotation of the photosensitive body 22 (the direction shown by arrow 4 in the drawing). The printing sections 12Y-K are also provided with printing frames 38Y-K, which support the respective photosensitive bodies 22, cleaning apparatuses 28, electrostatic chargers 30 and LED heads 32. Coupling of the neighboring printing frames 38Y-K to each other is implemented by joining together bases 54, which support the printing frames 38Y-K to enable raising and lowering thereof, with nuts and bolts, and positioning the printing frames 38Y-K with one another, via coupling plates, by fixing with screws. The base 54 that supports the printing frame 38Y is joined with the base 23 which supports the paper conveyance frame 21.

The transfer rollers 24Y-K rotate while abutting against upper faces of the photosensitive bodies 22 and, together with the photosensitive bodies 22, nip and convey the roll paper P. At these times, toner images which have been formed on the photosensitive bodies 22 by the developing apparatuses 34 are transferred to the roll paper P.

As shown in FIG. 1, each electrostatic charger 30 charges up a surface of the photosensitive body 22, and the LED head 32 exposes the surface of the photosensitive body 22 in lines to form a latent image. Then, the developing apparatus 34 causes toner to adhere on the latent image formed at the photosensitive body 22, to form a toner image. Further, the cleaning apparatus 28 scrapes off and removes remaining untransferred toner, which is not transferred to the roll paper P but remains at the surface of the photosensitive body 22. Guide rollers 40 are disposed to left and right of the transfer roller 24, and the roll paper P is conveyed by these guide rollers 40.

The developing apparatus 34 is provided with three developing magnet rollers 42, a transport magnet roller 44 and two stirring screws 48. The developing magnet rollers 42 are arranged along the axial direction of the photosensitive body 22. The transport magnet roller 44 is arranged along the axial direction of the three developing magnet rollers 42, and transports a two-component toner composed of toner and a carrier to the three developing magnet rollers 42. The stirring screws 48 are arranged along the axial direction of the transport magnet roller 44, and agitate and charge the toner and the carrier to cause mixing without variations.

The fixing section 16 is provided with a fixing apparatus 50, idling rollers 54A and 54B and paper ejection rollers 56. The fixing apparatus 50, the idling rollers 54A and 54B and the paper ejection rollers 56 are sequentially arranged in this order in the conveyance direction, and both end portions, in a direction intersecting the conveyance direction, of these components are supported at a fixing frame 58.

When the roll paper P passes through the fixing apparatus 50, the unfixed toner on the roll paper P is heated and fused, and solidifies again to fix to the roll paper P. The fixing apparatus 50 retains the roll paper P without contacting therewith, and is equipped with a plurality of flashlamps 50A along the direction intersecting the conveyance direction of the roll paper P. The flashlamps 50A emit light with predetermined timings, to heat and fuse the unfixed toner on the roll paper P.

Thereafter, the roll paper P that has passed through the fixing apparatus 50 is caused to switch direction and conveyed by the idling rollers 54A and 54B, which are disposed at a rear face side from a printing face of the roll paper P. The roll paper P is temporarily ejected from the fixing section 16, and passes through the paper ejection section 17. Thereafter, the roll paper P is returned to the fixing section 16 and is ejected by the paper ejection rollers 56.

At the paper ejection section 17, an idling roller 59A, a tensioning roller 60, a sub-driving roller 61, an idling roller 59B, a conveyance guide 62, an aligning roller 63 and an idling roller 59C are arranged in this order in the conveyance direction. Both end portions of these components in the direction intersecting the conveyance direction are supported at a paper ejection frame 65, directly or via support members. This paper ejection frame 65 is joined with the printing frame 38K and the fixing frame 58.

The sub-driving roller 61 is disposed upward of the idling roller 59A. The roll paper P, which is wound around the idling roller 59A and the sub-driving roller 61, is caused to switch direction and conveyed upward. The idling roller 59B presses against the sub-driving roller 61, rotates to follow rotation of the sub-driving roller 61 and, together with the sub-driving roller 61, nips and conveys the roll paper P.

The tensioning roller 60 is disposed between the idling roller 59A and the sub-driving roller 61. The roll paper P is zigzaggingly conveyed through a space between the idling roller 59A and the tensioning roller 60 and a space between the tensioning roller 60 and the sub-driving roller 61.

Each of two axial direction end portions of the tensioning roller 60 is supported, to be capable of swinging, by an arm. This arm is urged toward the roll paper P by an urging component such as a spring or the like, and the tensioning roller 60 is urged against the roll paper P. As a result, tension is applied to the roll paper P.

A position of the arm is detected by a sensor. A speed of rotation of the sub-driving roller 61 is continuously controlled so as to keep the position of the arm at a certain position.

The conveyance guide 62 and the aligning roller 63 are disposed at a conveyance direction downstream side of the sub-driving roller 61. The conveyance guide 62 and the aligning roller 63 correct skewing of the roll paper P with a structure similar to the conveyance guide 26 and aligning roller 27 provided at the paper conveyance section 14.

The idling roller 59C is disposed at a conveyance direction downstream side of the conveyance guide 62. The roll paper P is wound around this idling roller 59C and is caused to switch direction toward the paper ejection rollers 56 of the fixing section 16.

Herein, at a downstream side of the paper ejection rollers 56, when the roll paper P reaches a predetermined length, the roll paper P is cut to the predetermined length by a cutter and is ejected.

Now, the paper supply apparatus 100 will be described.

Figure 2:
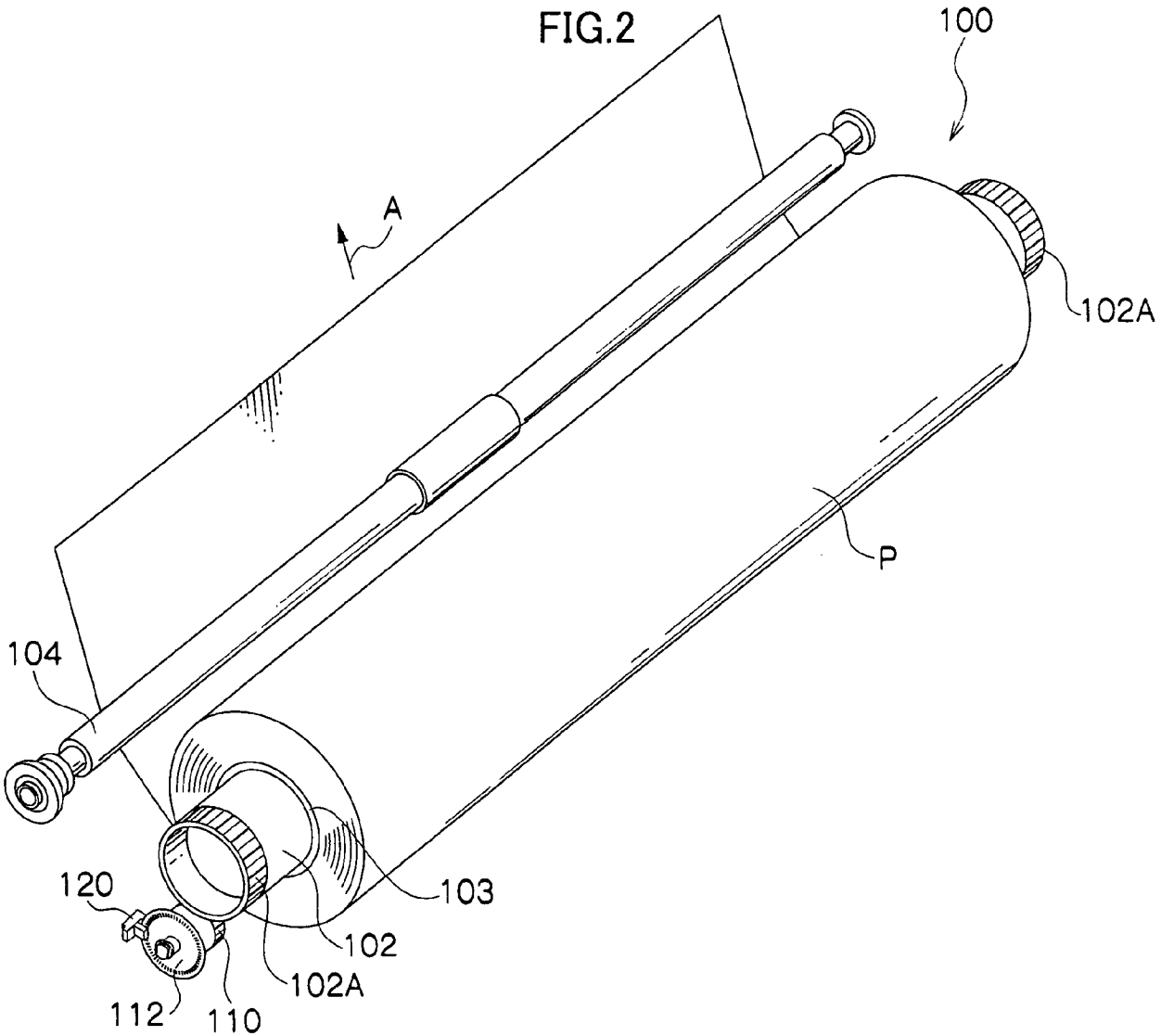
FIG. 2 is a schematic perspective view showing the paper supply apparatus relating to the first embodiment of the present invention.

As shown in FIG. 2, the roll paper P is wound on the winding core 103 in the form of a roll and, in a state in which the roll paper shaft 102 is inserted therethrough, is supported at the paper supply section frame 9 (see FIG. 1). The roll paper P and the roll paper shaft 102 are structured so as to rotate when the roll paper P is fed out in the direction of an arrow A by the paper feed roller 104. In the present embodiment, the roll paper P that is employed is of a type in which a trailing end portion (end portion) of the roll paper P is fixed to the winding core 103.

Figure 3:
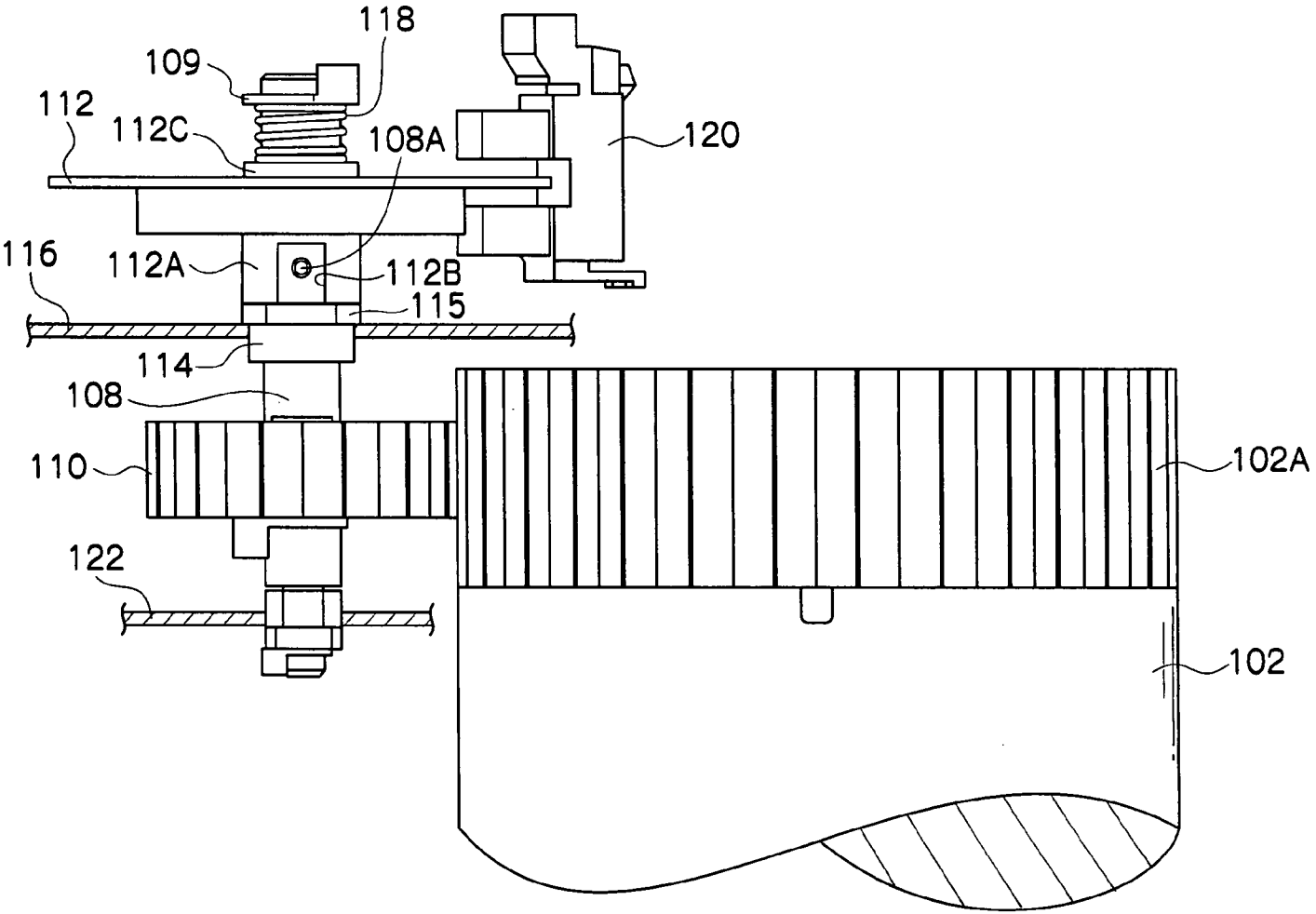
FIG. 3 is a partial enlarged view showing structure of a vicinity of a shaft which transmits rotary force of a roll paper shaft to a slit plate in the paper supply apparatus shown in FIG. 2.
Figure 4A:
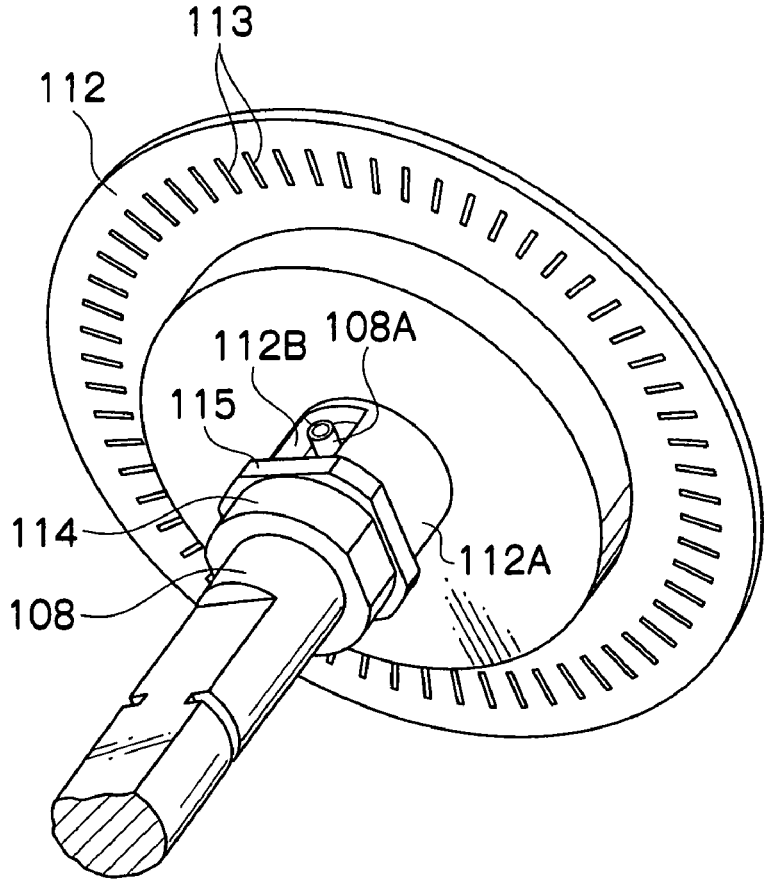
FIG. 4A is a perspective view showing a structure in which play is formed by an engagement channel, which is formed in a tube portion of the slit plate, and a pin of the shaft.
Figure 5:
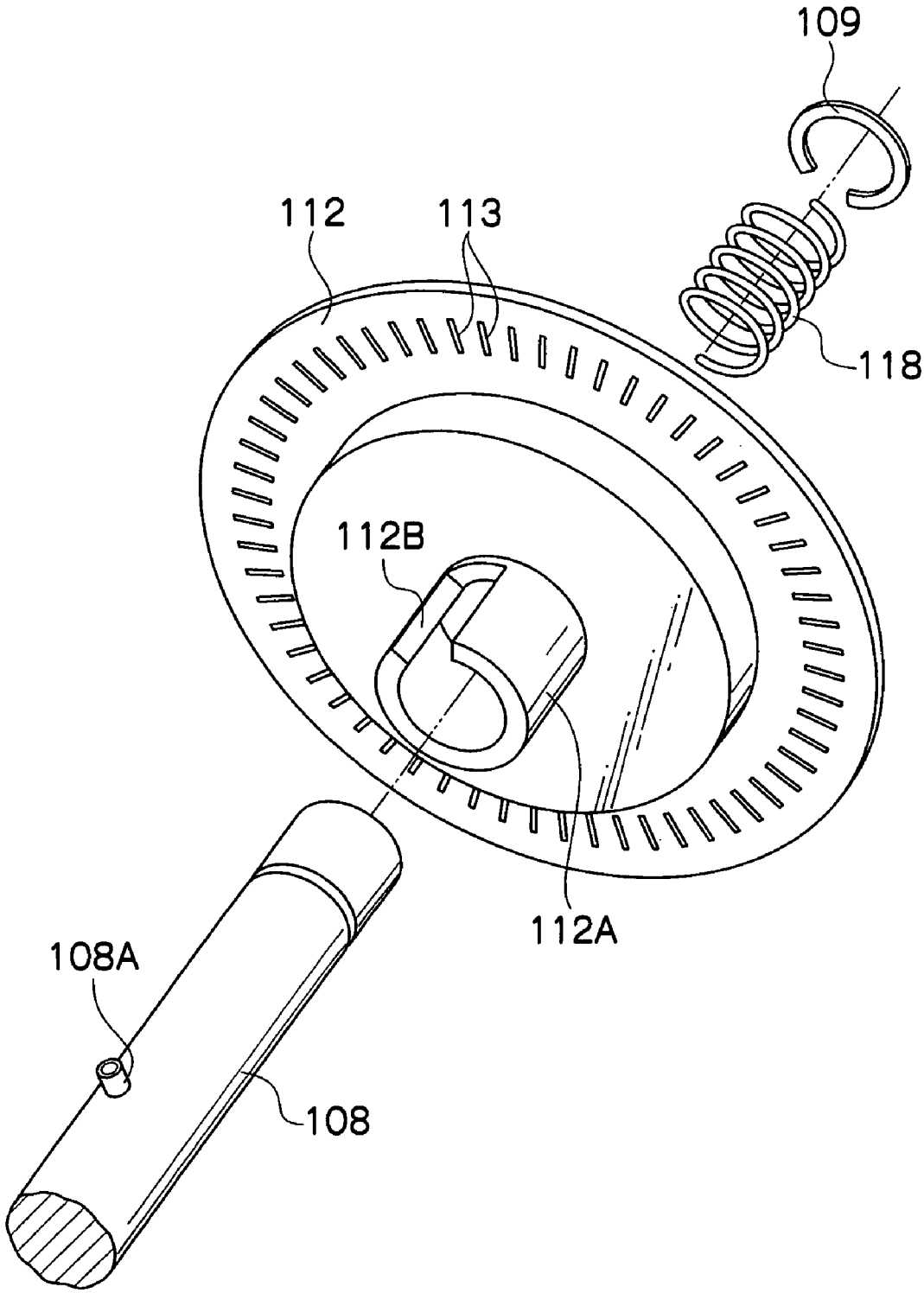
FIG. 5 is an exploded perspective view showing structure of the tube portion of the slit plate, the shaft, a spring, etc.

As shown in FIG. 3, at each of two axial direction end portions of the roll paper shaft 102, a gear 102A is formed. A shaft 108, which is substantially parallel with the roll paper shaft 102, is rotatably disposed at a position opposing one of the gears 102A. A gear 110, which is mounted at the shaft 108, meshes with this gear 102A. As shown in FIGS. 3 and 4A, the shaft 108 is freely rotatably inserted into a tube portion 112A, which is formed at a central portion of a slit plate 112. A substantially square engagement channel 112B is formed in the tube portion 112A. A pin 108A, which is formed at the shaft 108, is inserted into the engagement channel 112B (see the exploded view of FIG. 5). A width of the engagement channel 112B of the slit plate 112 is set to be wider than a diameter of the pin 108A. That is, play is formed such that the pin 108A and the engagement channel 112B are in a non-contacting state, such that it is possible to absorb agitations of the roll paper shaft 102.

As shown in FIG. 3, the shaft 108 is rotatably supported at a frame 116, via a bearing 114. A broad-diameter portion 115, which protrudes in a radial direction from the shaft 108, is formed at the bearing 114. This broad-diameter portion 115 abuts against the tube portion 112A. A flange portion 109, which protrudes in the radial direction from the shaft 108, is provided at a distal end portion of the shaft 108 which has been inserted through the tube portion 112A. A spring 118 is installed around the shaft 108, at an inward side relative to the flange portion 109. One end of the spring 118 abuts against a rear face side end portion 112C of the tube portion 112A, and the other end abuts against the flange portion 109. With this structure, an axial direction end portion of the tube portion 112A of the slit plate 112 is resiliently pushed against the broad-diameter portion 115 of the bearing 114 by the spring 118, so that frictional force is generated between the tube portion 112A and the bearing 114. Meanwhile, an end portion of the shaft 108 which is at an opposite end thereof from the slit plate 112 is rotatably supported at a frame 122.

Figure 6:
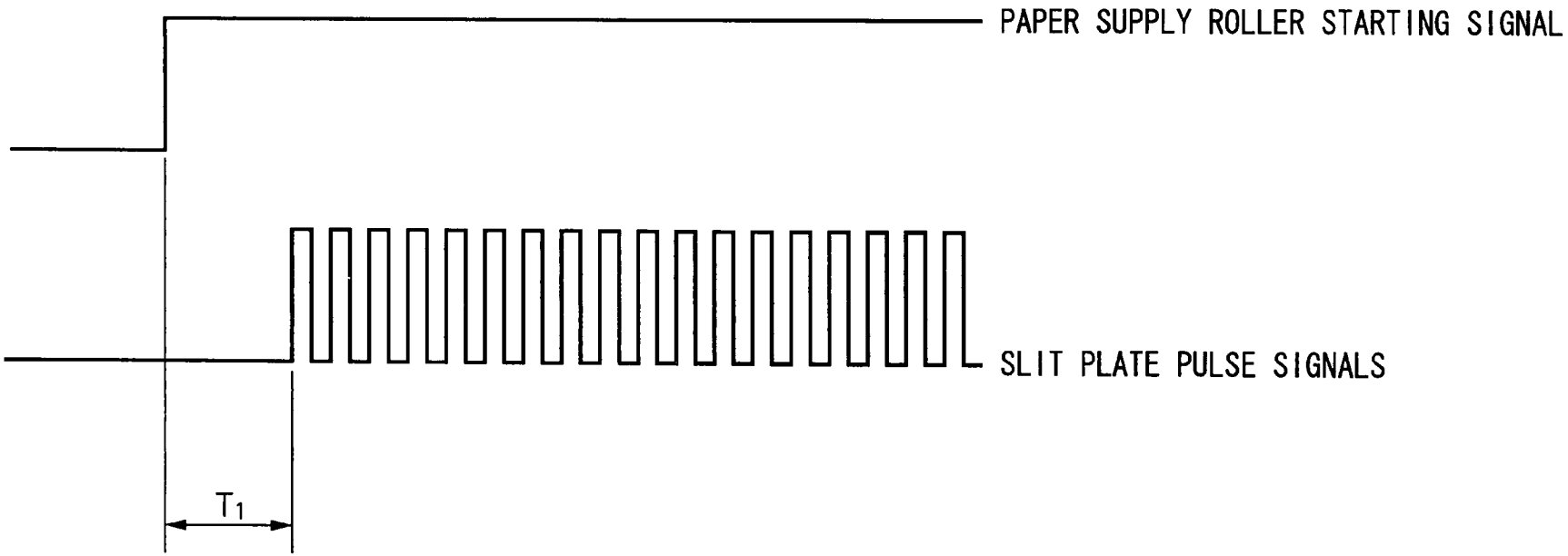
FIG. 6 is a timing diagram of performance of detection of pulse signals of the slit plate after a predetermined amount of time has passed after a signal for starting of a paper supply roller.

A plurality, in a circumferential direction, of slits 113 are formed in the slit plate 112 (see FIG. 4A). A photosensor 120 for detecting the slits 113 is disposed at a position sandwichingly opposing the slits 113. As shown in FIG. 6, the photosensor 120 detects the slits 113 of the slit plate 112 and outputs pulse signals. Remaining amounts of the roll paper P are sensed by monitoring of the pulse signals outputted by the photosensor 120. As is also shown in FIG. 6, the detection of the slits 113 by the photosensor 120 is specified to commence after a predetermined amount of time ($T_1$) has passed from a time of commencement of paper supply of the roll paper P, at which time a signal for starting of the paper feed roller 104 is outputted.

Next, operations of the paper supply apparatus 100 will be described.

Figure 4B:
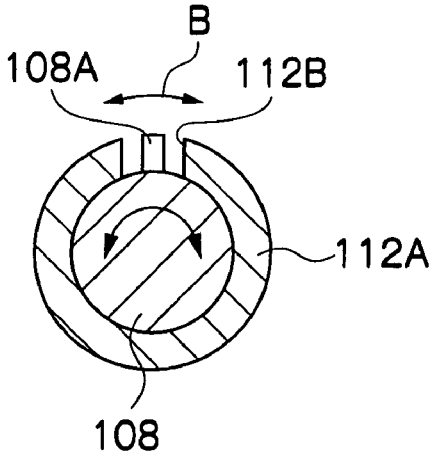
FIGS. 4B and 4C are sectional views showing the structure in which the play is formed by the engagement channel formed in the tube portion of the slit plate and the pin of the shaft.
Figure 4C:
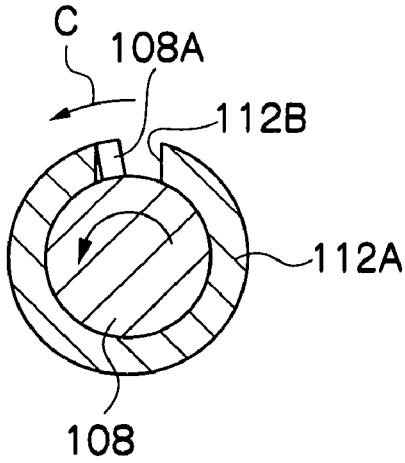

The paper feed roller 104 (see FIG. 2) is rotated by a motor, the roll paper P is fed out in the direction of arrow A, and the roll paper shaft 102 rotates. Hence, as shown in FIG. 3, the gear 110 meshing with the gear 102A rotates, and the shaft 108 rotates. At this time, as shown in FIG. 4C, the pin 108A formed at the shaft 108 rotates in the direction of an arrow C, and the pin 108A abuts against an edge portion of the engagement channel 112B. Rotary force of the shaft 108 is transmitted to the tube portion 112A by the pin 108A, and the slit plate 112 at which the tube portion 112A is provided rotates.

While the roll paper P is unwinding from the winding core 103, rotary force of the roll paper shaft 102 is transmitted and the slit plate 112 rotates. The slits 113 of the slit plate 112 are sensed by the photosensor 120. By counting the pulses that are outputted by the photosensor 120 in accordance with rotation of the roll paper P, remaining amounts of the roll paper P are detected.

The trailing end portion (end portion) of the roll paper P is fixed to the winding core 103. When the roll paper P has been fully unwound, the roll paper P enters a tautened state between the paper feed roller 104 unwinding the roll paper P (see FIG. 2) and the winding core 103, and the roll paper shaft 102 does not rotate any more. In a conventional paper supply apparatus, as described earlier, with roll paper P of which a trailing end portion is fixed, an effect in which a roll paper shaft rocks slightly occurs, because of slippage between a paper supply roller and the roll paper P, and the like. However, in the paper supply apparatus 100 of the present embodiment, as shown in FIG. 4B, the width of the engagement channel 112B of the slit plate 112 is set to be wider than the diameter of the pin 108A. Thus, if the roll paper shaft 102 rocks in the directions of the arrows, the pin 108A moves in the direction of arrow B, and the pin 108A and the engagement channel 112B enter a non-contacting state. Consequently, the small agitations of the roll paper shaft 102 are absorbed. Furthermore, because of the structure such that frictional force is generated between the slit plate 112 and the bearing 114 by the spring 118, the small agitations of the roll paper shaft 102 are not transmitted to the slit plate 112 and the slit plate 112 stops. Consequently, no pulses are counted by the photosensor 120, and the fact that there is no more roll paper P can be detected accurately. Therefore, because the slit plate does not oscillate and pulses are not counted by the photosensor as in the conventional case, a failure in which the detection that there is no more roll paper P is greatly delayed can be prevented.

Furthermore, because the spring 118 is provided between the tube portion 112A of the slit plate 112 and the flange portion 109 of the shaft 108, even if there are inconsistencies in the structural components, there will be no axial direction variations of the slit plate 112, and detection accuracy is improved.

Further again, because the detection of the slits 113 by the photosensor 120 is commenced after the predetermined amount of time ($T_1$) has passed after the commencement of supply of the roll paper P, it is possible to detect a remaining amount of the roll paper P with any effect from the non-contacting state prior to the pin 108A abutting against the engagement channel 112B having been eliminated.

Next, paper supply apparatuses of other embodiments of the present invention will be described.

Here, members that are the same as in the first embodiment are assigned the same reference numerals, and duplicative descriptions are omitted.

Figure 7A:
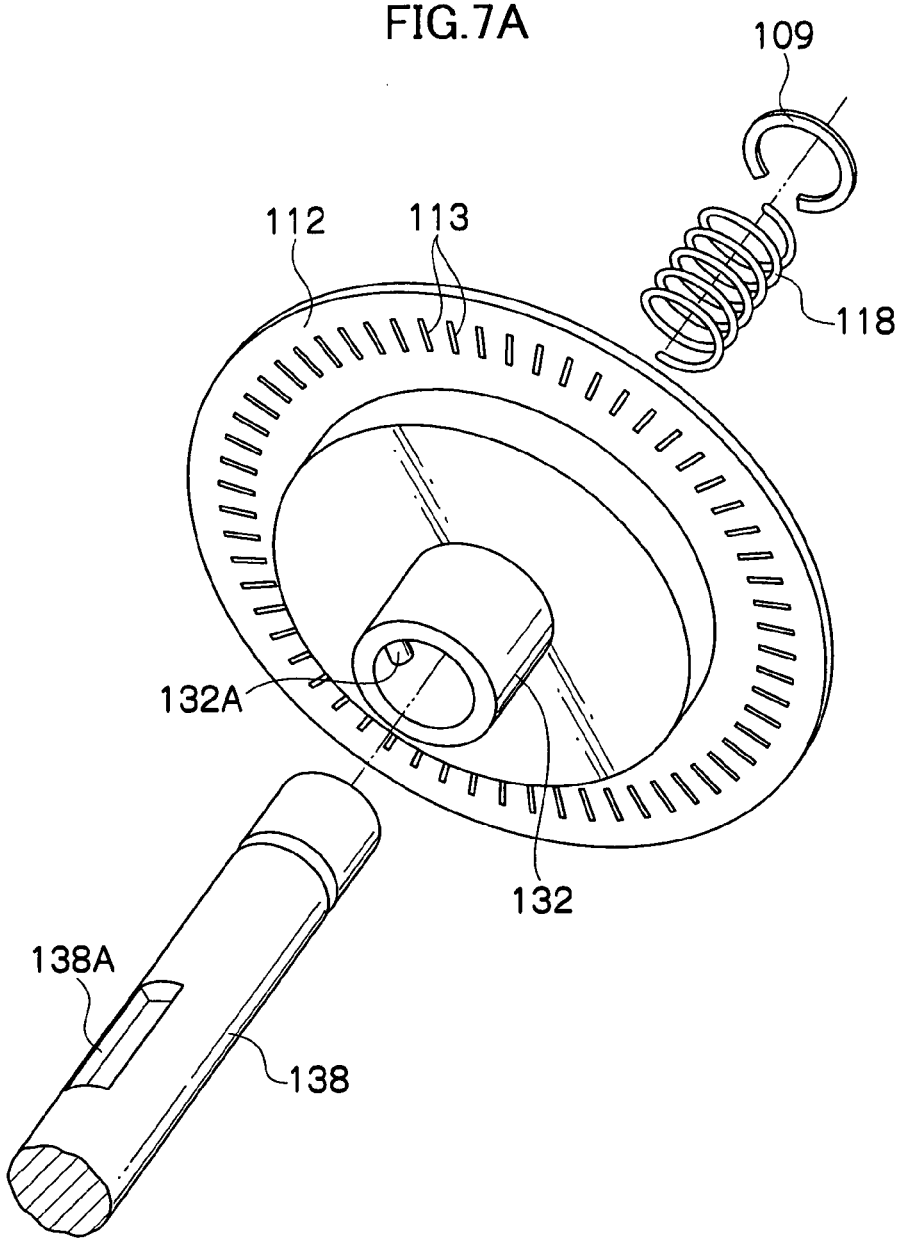
FIG. 7A is an exploded perspective view showing structure of a tube portion of a slit plate, a shaft, a spring, etc. in a paper supply apparatus relating to a second embodiment of the present invention.
Figure 7B:
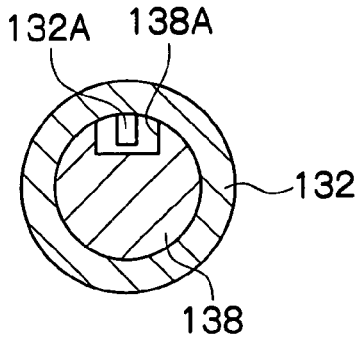
FIG. 7B is a sectional view showing structure of the tube portion of the slit plate, the shaft, the spring, etc. in the paper supply apparatus relating to the second embodiment of the present invention.

As shown in FIGS. 7A and 7B, in a paper supply apparatus of a second embodiment, a pin 132A is provided at an inner side of a tube portion 132 of the slit plate 112. Further, a recess-form engagement portion 138A, into which the pin 132A is inserted, is formed at a shaft 138 which transmits rotary force of the roll paper shaft 102 (see FIG. 3). A width of the engagement portion 138A is set to be wider than a diameter of the pin 132A, and play such that the pin 132A and the engagement portion 138A are in a non-contacting state is formed. When there is no more of the roll paper P, even if the roll paper shaft 102 (see FIG. 3) agitates slightly, the agitations can be absorbed by the pin 132A and the engagement portion 138A being in the non-contacting state. Therefore, the small agitations are not transmitted to the slit plate 112, and the fact that there is no more roll paper P can be detected accurately.

Figure 8:
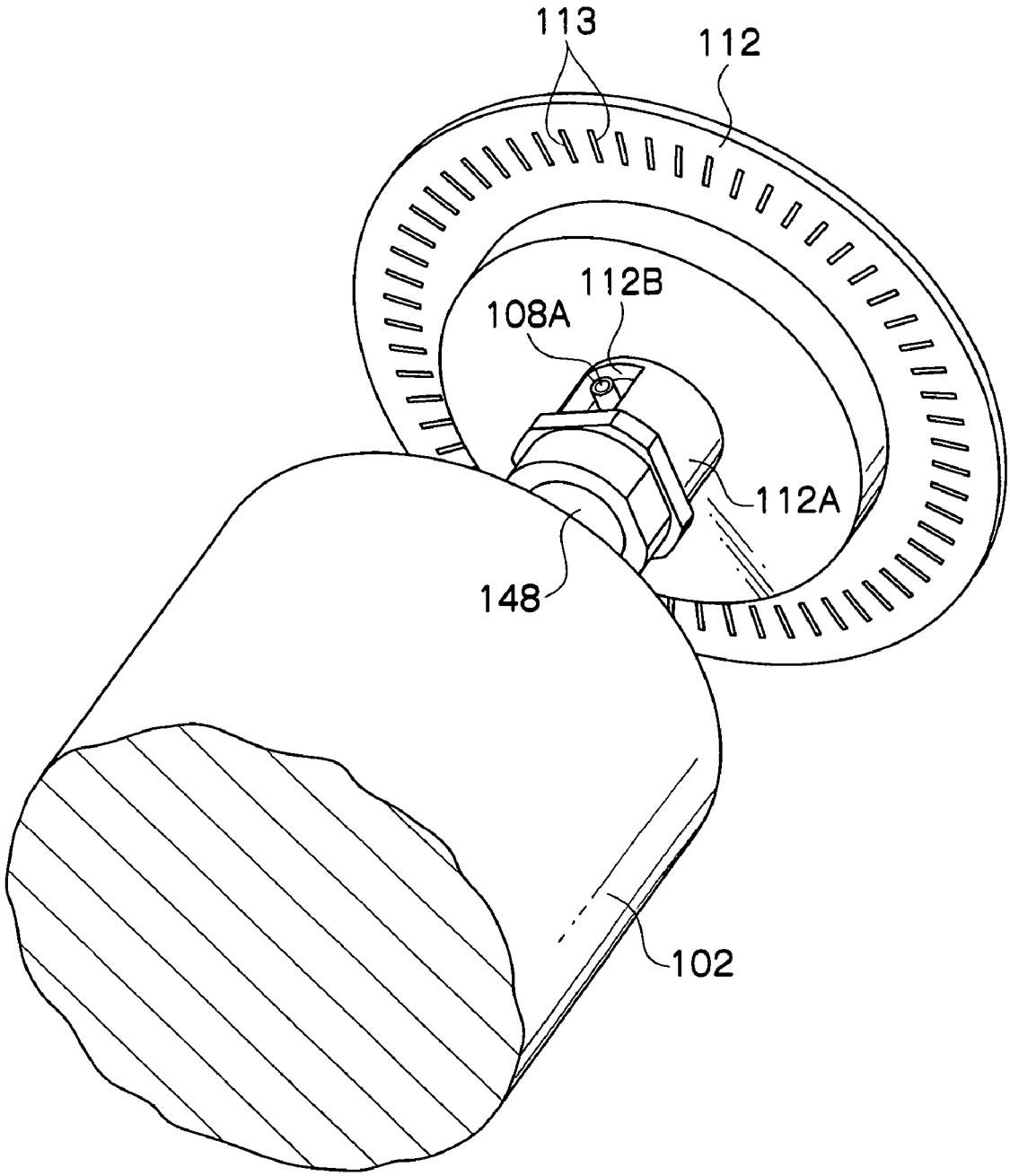
FIG. 8 is a perspective view showing structure of a tube portion of a slit plate, a shaft, a roll paper shaft, etc. in a paper supply apparatus relating to a third embodiment of the present invention.

As shown in FIG. 8, in a paper supply apparatus of a third embodiment, a shaft 148 is directly coupled with the roll paper shaft 102. The pin 108A is formed at the shaft 148, and the pin 108A is inserted into the engagement channel 112B of the tube portion 112A. Further, at a rear face side of the slit plate 112, the flange portion 109 is provided at the shaft 148 with a structure the same as in FIG. 3, and the spring 118 is installed between the flange portion 109 and the slit plate 112. In this structure too, play is provided such that the pin 108A and the engagement channel 112B are in a non-contacting state. Thus, slight oscillations of the roll paper shaft 102 (see FIG. 3) can be absorbed. Therefore, the small oscillations are not transmitted to the slit plate 112, and the fact that there is no more roll paper P can be detected accurately.

Figure 9B:
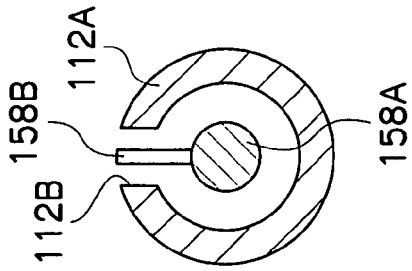
FIGS. 9A and 9B are partial enlarged views showing structure of a vicinity of a shaft which transmits rotary force of a roll paper shaft to a slit plate in a paper supply apparatus relating to a fourth embodiment of the present invention.
Figure 9A:
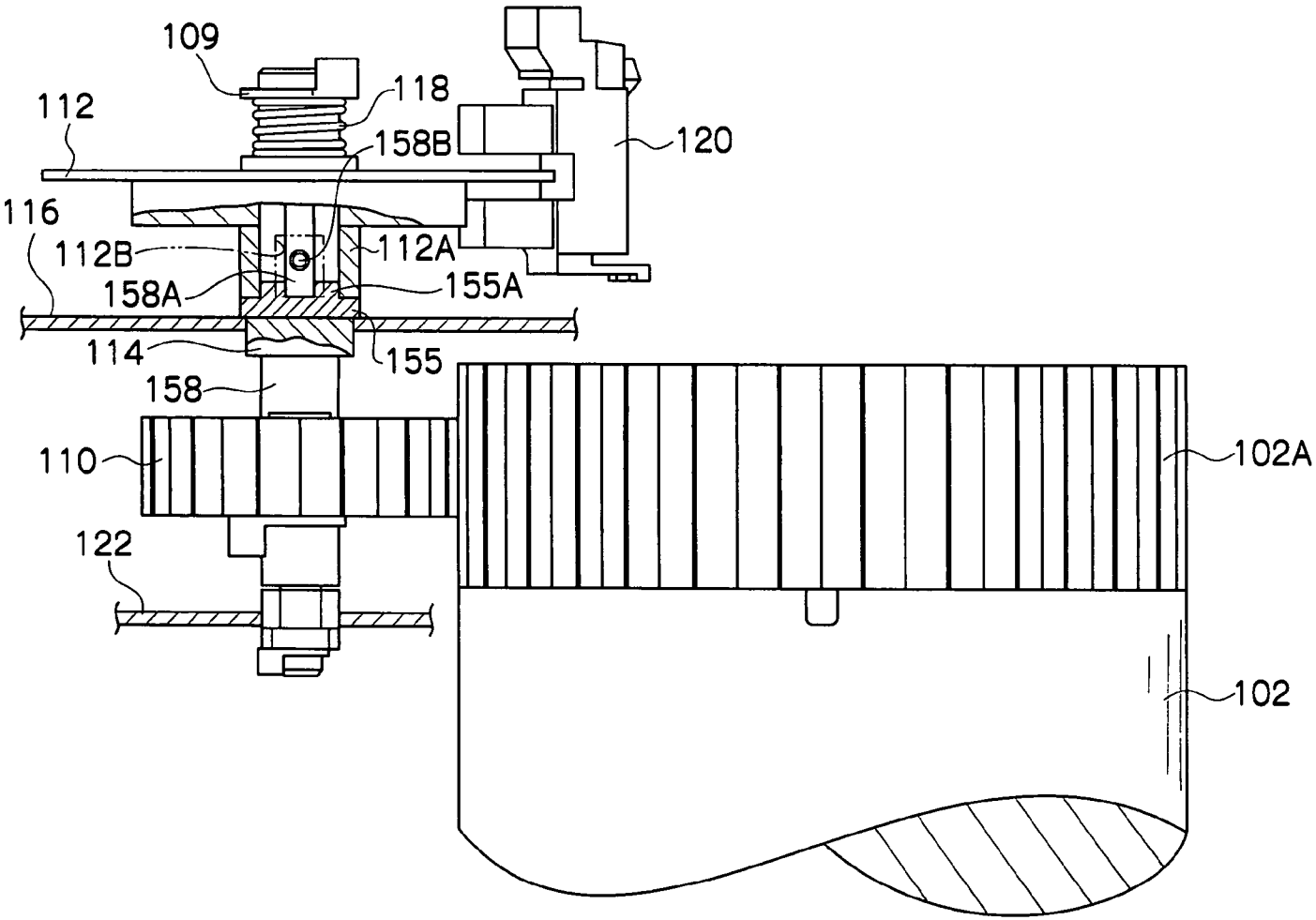
Figure 10:
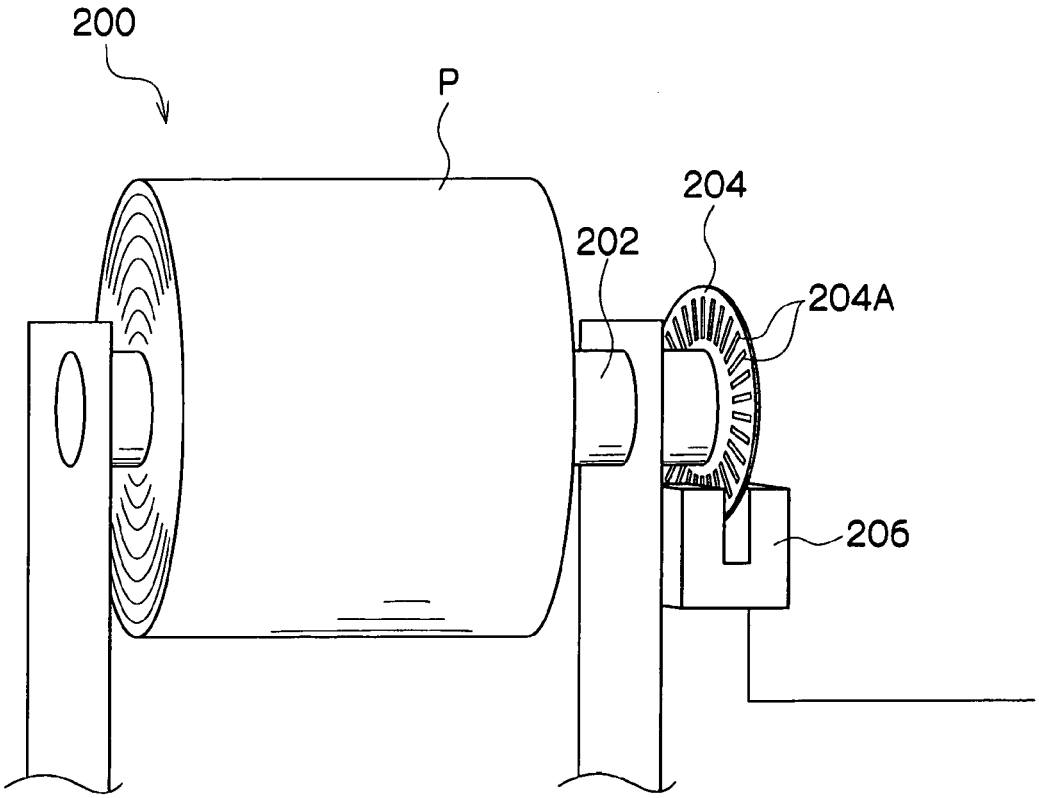
FIG. 10 is a structural view showing a shaft and a slit plate of a paper supply apparatus of related art.

As shown in FIGS. 9A and 9B, in a paper supply apparatus of a fourth embodiment, a shaft 158 is provided, which transmits rotary force of the roll paper shaft 102 (see FIG. 3). A shaft opposition portion 158A of the shaft 158, which opposes the tube portion 112A, is specified to have an outer diameter smaller than an inner periphery of the tube portion 112A. Therefore, as shown in FIG. 9B, the shaft opposition portion 158A is inserted at the inner periphery of the tube portion 112A of the slit plate 112 in a non-contacting state. A pin 158B, which is formed at the shaft opposition portion 158A, is inserted into the engagement channel 112B.

As shown in FIG. 9A, at a broad-diameter portion 155 of the bearing 114, a step portion 155A with a small diameter, which protrudes from the shaft opposition portion 158A substantially in parallel with the axial direction thereof is provided. The axial direction end portion of the tube portion 112A is supported at this step portion 155A. In this structure, because the tube portion 112A of the slit plate 112 is in a non-contacting state with the shaft opposition portion 158A, effects of friction between the tube portion 112A and the shaft opposition portion 158A can be reduced.

Note that although, in the embodiments described above, the play between the tube portion of the slit plate 112 and the shaft is formed by the engagement channel 112B and the pin 108A, the engagement portion 138A and the pin 132A, or the like, embodiments are not limited to such structures. Any form can be suitably specified as long as a structure thereof is capable of forming play such that there is a non-contacting state between the slit plate 112 and the shaft.

As has been described above, the first aspect of the present invention is a paper supply apparatus including: a support component, which rotatably retains a winding core round which roll paper is wound; a slit plate, which rotates integrally or interlockingly with the support component for causing pulses to be generated at a sensor; and a rotation force transmission component, which transmits a rotary force of the support component to the slit plate, wherein predetermined play in a direction of rotation of the slit plate is provided at the rotation force transmission component.

According to the first aspect, when the roll paper is unwound from the winding core, the support component retaining the winding core rotates, and the slit plate is rotated by the rotation force transmission component. The slits of this slit plate are detected by the sensor, and a remaining amount of the roll paper is calculated on the basis of a count of pulses that are outputted by the sensor.

With roll paper at which a trailing end of the roll paper is fixed to the winding core, when the roll paper has been fully unwound, the roll paper enters a tautened state between a feed roller which unwinds the roll paper and the winding core, and the support component retaining the winding core stops rotating.

Here, if the rotation of the support component retaining the winding core stops completely, the slit plate also does not rotate. Thus, it is possible to judge that there is no more roll paper without counting pulses from the sensor.

In a conventional paper supply apparatus, the slit plate would be fixed at an end portion of the support component retaining the winding core. Consequently, when the feed roller tautened the roll paper and the support component retaining the winding core jerked slightly in a paper feeding direction and a paper return direction, the slit plate would be accordingly agitated. As a result, the sensor would detect the slits of the slit plate and would mistakenly detect that there was still roll paper.

However, at the rotation force transmission component of the present invention, the predetermined play in the direction of rotation of the slit plate is provided. Consequently, a slight play of the support component retaining the winding core is absorbed at the play of the rotation force transmission component, and is not transmitted to the slit plate. Therefore, the slit plate will stop even when the support component which retains the winding core is oscillating, and it is possible to detect that there is no more roll paper with good accuracy.

In the paper supply apparatus of the first aspect, the rotation force transmission component may be structured with: a rotating member, which rotates in conjunction with the support component and which rotatably supports the slit plate; a first transmission member, which is provided at the rotating member; and a second transmission member which, consequent to rotation of the rotating member, abuts against the first transmission member and transmits rotary force to the slit plate, and which is capable of forming the play in the form of a non-contacting state.

The first transmission member abuts against the second transmission member and transmits rotary force of the rotating member to the slit plate. Play in the form of a mutually non-abutting state is formed between the first transmission member and the second transmission member. Consequently, small agitations of the support component retaining the winding core are absorbed, and are not transmitted to the slit plate. Therefore, the slit plate stops even if the support component retaining the winding core is agitating. Thus, it is possible to detect that there is no more roll paper with good accuracy.

In the paper supply apparatus of the first aspect, a tube portion may be formed at the slit plate, with the rotating member being rotatably inserted into the tube portion, and an axial direction end portion of the tube portion may be urged by a spring member toward a broad-diameter portion, which protrudes in a radial direction from the rotating member.

Because the axial direction end portion of the slit plate is urged by the spring member, even if there are variations in components, there will be no variations of the slit plate in the axial direction, and detection accuracy is improved.

In the paper supply apparatus of the first aspect, an internal diameter of the tube portion and an external diameter of the rotating member may be specified such that the tube portion is in a non-contacting state with the rotating member, and the tube portion may be supported at a step portion which protrudes from the rotating member in parallel with the axial direction.

The tube portion is supported at the step portion which extends from the rotating member in parallel with the axial direction, and the tube portion and the rotating member are in a non-contacting state. Therefore, the slit plate will not be affected by friction of the rotating member against the tube portion. Consequently, it is possible to detect that there is no more roll paper with even better accuracy.

In the paper supply apparatus of the first aspect, detection of slits of the slit plate by the sensor may commence after a predetermined amount of time has passed after commencement of paper supply.

Because slit detection is commenced subsequent to the passage of the predetermined amount of time after the commencement of paper supply, it is possible to detect a remaining amount of the roll paper with any effect from the play at the time of commencement of paper supply having been eliminated.

The second aspect of the present invention is an image formation device which is equipped with the paper supply apparatus of the first aspect, and which conveys the roll paper, which is fed from the paper supply apparatus, to an image formation section and forms an image on the roll paper.

According to the second aspect, because the paper supply apparatus of the first aspects, is provided, it is possible to accurately detect that there is no more roll paper during formation of images on the roll paper. Consequently, it is possible to avoid problems in operation of the image formation device due to erroneous detections.

According to the present invention, it is possible to perform detection of remaining amounts of roll paper accurately with a simple structure, and it is possible to prevent a delay in detection when there is no more roll paper.

What is claimed is:

1. A paper supply apparatus comprising:

a support component, which rotatably retains a winding core around which roll paper is wound;

a slit plate, which rotates in response to the support component and causes pulses to be generated at a sensor; and a rotation force transmission component, which transmits a rotary force of the support component to the slit plate, wherein the transmission component is designed such that the support component must rotate at least a predetermined amount to cause rotation of the slit plate;

wherein the support component includes a support component gear and the transmission component includes a transmission component gear which meshes with the support component gear whereby the rotary force of the support component transmits rotation to the transmission component;

wherein the transmission component further comprises an engagement channel and a pin disposed in the engagement channel, the engagement channel being wider than the pin;

wherein when the support component transmits rotation to the transmission component, one of the pin and the engagement channel are rotated relative to the other of the pin and the engagement channel, the other of the pin and the engagement channel being connected to and moving with the slit plate; and wherein when the support component rotates at least the predetermined amount the one of the pin and the engagement channel are rotated sufficiently that the pin contacts a wall of the engagement channel whereby the rotary force is transmitted to the slit plate.

2. The paper supply apparatus of claim 1, wherein the rotation force transmission component includes a rotating member, the one of the pin and the engagement channel being formed on the rotating member.

3. The paper supply apparatus of claim 2, wherein a tube portion is formed at the slit plate, the rotating member being rotatably inserted into the tube portion, and an axial direction end portion of the tube portion is urged by a spring member toward a broad-diameter portion, which protrudes in a radial direction from the rotating member.

4. The paper supply apparatus of claim 3, wherein an internal diameter of the tube portion and an external diameter of the rotating member are specified, in which the internal diameter of the tube portion is greater than the external diameter of the rotating member, such that the tube portion is in a non-contacting state with the rotating member, and the tube portion is supported at a step portion which protrudes from the rotating member in parallel with the axial direction.

5. The paper supply apparatus of claim 1, wherein detection of slits of the slit plate by the sensor commences after a predetermined amount of time has passed after commencement of paper supply.

6. The paper supply apparatus of claim 1, wherein a clearance between the pin and the engagement channel is greater than a standard manufacturing tolerance.

7. The paper supply apparatus of claim 1, where the one of the pin and the engagement channel comprises the rotating in reference to the engagement channel.

8. An image formation device comprising:

a paper supply apparatus; and an image formation section, wherein the paper supply apparatus includes:

a support component, which rotatably retains a winding core around which roll paper is wound;

a slit plate, which rotates in response to the support component and causes pulses to be generated at a sensor; and a rotation force transmission component, which transmits a rotary force of the support component to the slit plate, wherein the transmission component is designed such that the support component must rotate at least a predetermined amount to cause rotation of the slit plate, wherein the support component includes a support component gear and the transmission component includes a transmission component gear which meshes with the support component gear whereby the rotary force of the support component transmits rotation to the transmission component;

wherein the transmission component further comprises an engagement channel and a pin disposed in the engagement channel, the engagement channel being wider than the pin;

wherein when the support component transmits rotation to the transmission component, one of the pin and the engagement channel are rotated relative to the other of the pin and the engagement channel, the other of the pin and the engagement channel being connected to and moving with the slit plate;

wherein when the support component rotates at least the predetermined amount the one of the pin and the engagement channel are rotated sufficiently that the pin contacts a wall of the engagement channel whereby the rotary force is transmitted to the slit plate; and wherein the image formation section conveys the roll paper, which is fed from the paper supply apparatus, to the image formation section, and forms an image on the roll paper.

9. The image formation device of claim 8, wherein the rotation force transmission component includes a rotating member, the one of the pin and the engagement channel being formed on the rotating member.

10. The image formation device of claim 9, wherein a tube portion is formed at the slit plate, the rotating member being rotatably inserted into the tube portion, and an axial direction end portion of the tube portion is urged by a spring member toward a broad-diameter portion, which protrudes in a radial direction from the rotating member.

11. The image formation device of claim 10, wherein an internal diameter of the tube portion and an external diameter of the rotating member are specified, in which the internal diameter of the tube portion is greater than the external diameter of the rotating member, such that the tube portion is in a non-contacting state with the rotating member, and the tube portion is supported at a step portion which protrudes from the rotating member in parallel with the axial direction.

12. The image formation device of claim 8, wherein detection of slits of the slit plate by the sensor commences after a predetermined amount of time has passed after commencement of paper supply.

13. The image formation device of claim 8, wherein a clearance between the pin and the engagement channel is greater than a standard manufacturing tolerance.

14. The paper supply apparatus of claim 8, where the one of the pin and the engagement channel comprises the rotating in reference to the engagement channel.

* * * * *